US005121307A

United States Patent [19]

Moore

[11] Patent Number: 5,121,307

[45] Date of Patent: Jun. 9, 1992

[54] SELF CONTAINED SOLAR POWERED STROBE LIGHT

[76] Inventor: Charles M. Moore, 1500 Old Naches Hwy., Naches, Wash. 98937

[21] Appl. No.: 756,433

[22] Filed: Sep. 9, 1991

[51] Int. Cl.[5] ..... F21L 7/00

[52] U.S. Cl. ..... 362/183; 340/985; 136/291

[58] Field of Search ..... 362/183, 191, 157; 340/985, 984; 136/291

[56] References Cited

U.S. PATENT DOCUMENTS 4,319,310 3/1982 Kingsley ..... 362/183
4,481,562 11/1984 Hickson ..... 362/183
4,759,735 7/1988 Pagnol et al. ..... 340/985
5,066,338 11/1991 Meyers ..... 362/183

*Primary Examiner*—Carroll B. Dority
*Attorney, Agent, or Firm*—Warren F. B. Lindsley

[57] ABSTRACT

A pole mounted self contained solar powered strobe light utilizing ultra violet rays from the sun and moon for charging its batteries and employing a cylindrical housing open at one end for fitting over the top of a vertically mounted pole. Batteries are insertable in the other end of the housing which are covered by a cap for closing this end of the housing. The cap has mounted on it a strobe light connected to the batteries and covered by a transparent magnifying lens.

6 Claims, 1 Drawing Sheet

SELF CONTAINED SOLAR POWERED STROBE LIGHT

BACKGROUND OF THE INVENTION

This invention relates to a self contained solar powered strobe light serving as a warning device for low flying aircraft and more particularly to a device that utilizes ultra violet rays from the sun and the moon to charge batteries for powering a strobe light of varying power and strobe frequencies.

The disclosed device operates safely in the static electrical fields of high voltages A.C. and D.C. power lines and in or near caustic and chemical areas. It may also operate in close proximity to regular and unusual aircraft flight areas and on or near tall structures and other locations where typical means of powering warning devices is hindered or prohibited.

DESCRIPTION OF THE PRIOR ART

Although solar power is being used to operate electronic light emitting devices, none are known that function in the manner of this invention.

U.S. Pat. No. 4,319,310 discloses a self-contained solar sign utilizing incident solar energy employing solar cells or thermal absorbers for generating electricity which is stored and later used for energizing sign illuminating lamp or lamps.

SUMMARY OF THE INVENTION

In accordance with the invention claimed, a new and improved warning device is provided for helicopters and low flying aircraft which may function also as a marker for indicating airports during emergency or temporary air operations.

It is, therefore, one object of this invention to provide an improved self contained solar powered strobe light.

Another object of this invention is to provide an improved strobe light which is functional in the static electrical fields of high voltage A.C. and D.C. power lines and in close proximity to caustic and chemical environments.

A further object of this invention is to provide an improved self contained weather tight solar powered strobe light that may function at remote locations in severe heat, wind, ice, lightning and rain conditions.

A still further object of this invention is to provide a self contained solar powered strobe light that employs a dual purpose lens that amplifies the flashes of the strobe and functions as a self cleaning device due to its geometrical configuration.

Yet another object of this invention is to provide an improved self contained strobe light the geometrical form of which keeps birds from nesting on or near the strobe light.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described with reference to the accompanying drawing in which.

DESCRIPTION OF THE PREFERRED EMBODIMENT

Figure 1:
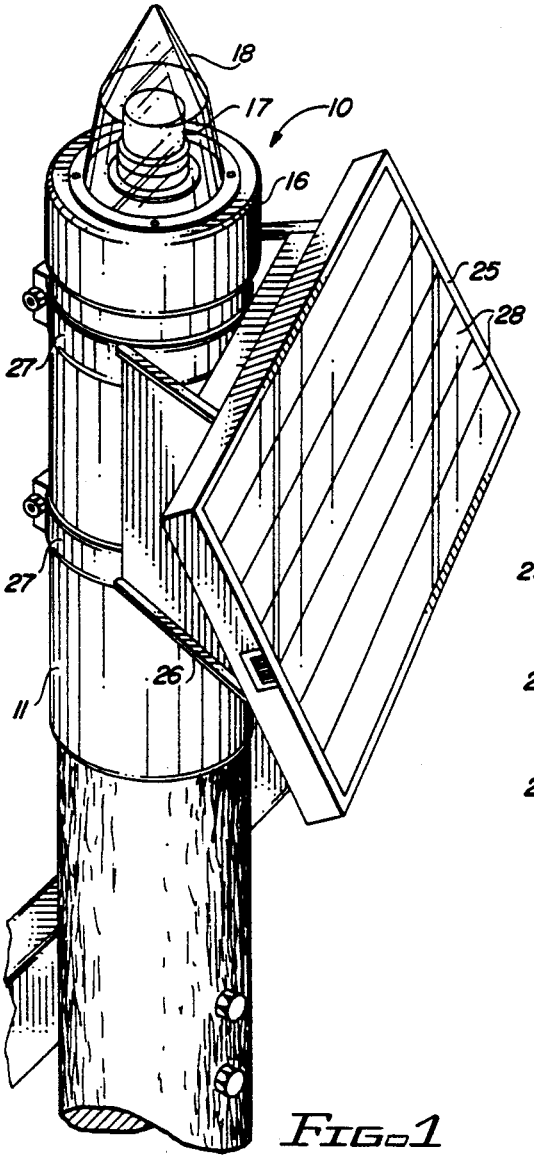
FIG. 1 is a perspective view of a self contained solar powered strobe light mounted on the top of a pole and embodying the invention.
Figure 4:
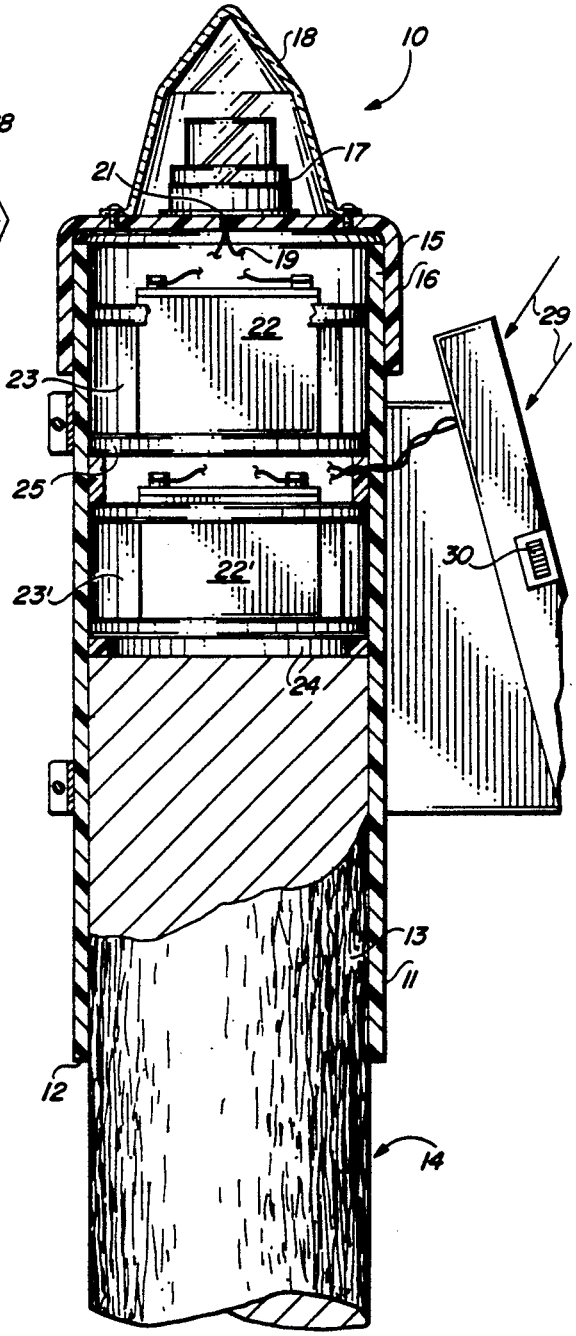
FIG. 4 is a cross sectional view of FIG. 1.

Referring more particularly to the drawing by characters of reference, FIGS. 1 and 4 disclose a self contained solar powered strobe light 10 for use in remote as well as clustered urban conditions as an emergency marker or permanent safety fixture particularly for helicopters and other low flying aircraft.

The strobe light 10 comprises a cylindrical housing 11 open at one end 12 for fitting over the top end 13 of an electric power or telephone pole 14. The other end 15 of cylindrical housing 11 is closed by a cap 16 which may be press fitted over its end 16. Cap 15 serves as a mounting platform for a strobe light 17 which is covered by a lens 18 that not only magnifies the strobe light but also serves as a self cleaning transparent cover for it.

As noted, the strobe light is mounted in the center of cap 16 on the top end of a vertically mounted pole which provides a full 360 degrees of visibility for each flash of the warning light.

FIG. 4 illustrates the interconnection through wires 19 of strobe light 17 with a power source. As noted, wires 19 pass through an access hole 21 in cap 16.

The power source may comprise a pair of batteries 22, 22' each resting in an associated cradle 23, 23'. These cradles may be formed out of a suitable insulating material such as wood or plastic. As noted, top battery 22 and associated cradle 23 may be removed when cap 16 is removed from housing 11 to obtain access to lower battery 22' and its associated cradle 23'. These cradles prevent the batteries from shifting or tipping during installation of strobe light 10 and keep the batteries in place during severe wind storms or earthquake conditions that might cause a tower, pole or other structure on which the strobe light is mounted to sway. These cradles are held in place by PVC strips 24 secured to the inner wall of housing 11 as shown in FIG. 4.

In order to maintain batteries 22, 22' charged, a solar panel 25 is mounted on housing 11 by means of a frame 26 and associated clamps 27. This solar panel employs a rack of solar cells 28 such as suitable photovoltaic means oriented with their focal axis parallel to incident rays 29 of sunlight. Frame 26 is tiltable to a proper angle for the location at which it is intended to operate. Although the frame may be attached to housing 11 in any suitable manner, it is shown as being wrapped completely around housing 11.

The disclosed clamping means of the strobe light enables the light to be raised or lowered on housing 11. Once the desired elevation is reached, the installer can rotate the frame on the pole until solar panel 25 faces the proper direction for the most effective solar ray exposure.

It should be noted that the cylindrical strobe light presents a smooth surface to the wind so that the wind may freely flow around it and also serves as a housing for enclosing the batteries and associated wiring.

Figure 3:
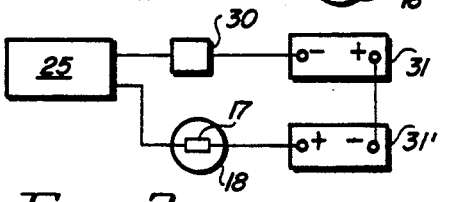
FIG. 3 is a schematic view of the electrical circuitry of FIG. 1 employing a 6 volt system.

FIG. 3 illustrates the electrical circuitry for a 12 volt system wherein two 12 volt batteries are connected in parallel. The solar panel 25 converts sunlight into electrical current which current is then regulated by a suitable voltage regulator 30 will known in the art which is located on the side or back of the solar panel. The regulated voltage from the solar panel may be connected through a diode (not shown) in regulator 30 across the terminals of a bank of parallelly arranged 12 volt batteries 22, 22'. Strobe light 17 is connected across the terminals of the parallelly connected batteries 22, 22'.

FIG. 3 illustrates a modification of the strobe light assembly showing strobe light 17 being connected across a pair of 6 volt batteries 31, 31' connected in a series arrangement.

Figure 2:
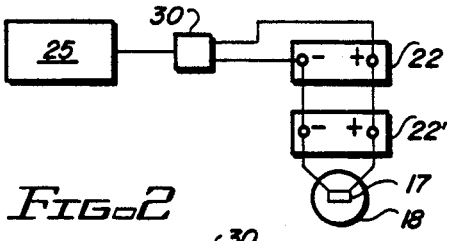
FIG. 2 is a schematic view of the electrical circuitry of FIG. 1 employing a 12 volt system.

Regulator 30 as used in the circuits of FIGS. 2 and 3 controls the electrical energy from solar panel 25 to the batteries of each circuit configuration so as to prevent overcharging of the batteries. The size and power of the strobe light and the interval of time between its flashes are determined by location and the function it must serve.

It should be noted that the housing, cap and lens are formed of suitable plastic material readily available in the marketplace. Thus, an economical strobe light assembly may be manufactured which has a long, maintenance free life.

Although but a single embodiment of the invention has been illustrated and described, it will be apparent to those skilled in the art that various changes and modifications may be made therein without departing from the spirit of the invention or from the scope of the appended claims.

What is claimed is:

1. A solar powered strobe light assembly comprising:

an open ended cylindrical housing for receiving in one end thereof the upright end of a pole, and in the other end an electrical D.C. power storage means, said electrical D.C. storage means comprising at least one battery, a cap for covering said other end of said housing, a strobe light mounted on said cap to extend axially outward therefrom, a transparent lens mounted on said cap and over said strobe light for magnifying the light admitted by said strobe light, and a plurality of photovoltaic cells mounted on the outside of said housing and exposed to the sun for collecting incident solar energy and converting it into electrical energy, conductor means for individually connecting said strobe light and said photovoltaic cell across the terminals of said battery, and voltage regulator means connected between said photovoltaic cells and said battery for controlling the electrical energy transmitted to said battery.

2. The solar powered strobe light assembly set forth in claim 1 wherein:

said D.C. storage means comprises more than one parallelly connected 12 volt battery vertically mounted in said housing.

3. The solar powered strobe light assembly set forth in claim 1 wherein:

said D.C. storage means comprises more than one serially connected 6 volt battery vertically mounted in said housing.

4. The solar powered strobe light assembly set forth in claim 1 in further combination with:

means for adjustably mounting said plurality of photovoltaic cells on said housing for controlling the position of said photovoltaic cells relative to the rays of the sun.

5. The solar powered strobe light assembly set forth in claim 1 wherein:

said housing, cap and lens are formed of a plastic material.

6. The solar powered strobe light assembly set forth in claim 1 wherein:

said lens comprises a pointed geometrical configuration providing a self cleaning function for discouraging birds from nesting thereon.

* * * * *